US010180123B2

(12) United States Patent
Schuerz et al.

(10) Patent No.: US 10,180,123 B2
(45) Date of Patent: Jan. 15, 2019

(54) METHOD FOR PRODUCING INJECTORS, IN PARTICULAR FUEL INJECTORS

(71) Applicant: Continental Automotive GmbH, Hannover (DE)

(72) Inventors: Willibald Schuerz, Pielenhofen (AT); Roman Etlender, Regensburg (DE); Werner Reim, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 103 days.

(21) Appl. No.: 14/901,340

(22) PCT Filed: Jun. 23, 2014

(86) PCT No.: PCT/EP2014/063129
§ 371 (c)(1),
(2) Date: Dec. 28, 2015

(87) PCT Pub. No.: WO2014/206924
PCT Pub. Date: Dec. 31, 2014

(65) Prior Publication Data

US 2016/0146169 A1 May 26, 2016

(30) Foreign Application Priority Data

Jun. 26, 2013 (DE) ..... 10 2013 212 330

(51) Int. Cl.
*F02B 3/00* (2006.01)
*F02M 51/06* (2006.01)
(Continued)

(52) U.S. Cl.
CPC ..... *F02M 51/0607* (2013.01); *F02M 61/12* (2013.01); *F02M 61/168* (2013.01); *F02M 61/18* (2013.01)

(58) Field of Classification Search
CPC .. F02M 51/0607; F02M 61/12; F02M 61/168; F02M 61/18; F02M 63/00; F02M 61/16
(Continued)

(56) References Cited

U.S. PATENT DOCUMENTS 6,085,726 A * 7/2000 Lei ..... F02M 47/025 123/446
7,377,040 B2 * 5/2008 Hornby ..... F02M 51/0682 219/121.64
(Continued)

FOREIGN PATENT DOCUMENTS

DE 102009027103 A1 12/2010 ..... F02M 47/02
DE 102009045348 * 4/2011 ..... F02M 61/168
(Continued)

OTHER PUBLICATIONS

Chinese Office Action, Application No. 201480036640.6, 16 pages, dated Apr. 1, 2017.
(Continued)

*Primary Examiner* — Hung Q Nguyen
*Assistant Examiner* — Anthony Taylor, Jr.
(74) *Attorney, Agent, or Firm* — Slayden Grubert Beard PLLC

(57) ABSTRACT

A method is provided for pairing at least two injectors, e.g., two fuel injectors for a direct injection system of an internal combustion engine, wherein a criterion for the pairing of the at least two injectors is a total leakage and/or a pressure difference at a transfer pin of the respective injector. A method for producing an injector, e.g., a fuel injector for a direct injection system of an internal combustion engine, is also provided, wherein at least two instances of mechanical backlash, e.g., instances of pairing backlash, that are relevant to injection amounts, leakage amounts, and/or pressure differences of the injector are paired with each other.

12 Claims, 5 Drawing Sheets

(51) Int. Cl.
*F02M 61/16* (2006.01)
*F02M 61/12* (2006.01)
*F02M 61/18* (2006.01)

(58) Field of Classification Search
USPC ..... 123/294
See application file for complete search history.

(56) References Cited

U.S. PATENT DOCUMENTS

| | | | | |
|---|---|---|---|---|
| 7,478,626 | B2 | 1/2009 | Schürz | 123/490 |
| 8,055,437 | B2 * | 11/2011 | Proietty | F02D 41/1445 340/439 |
| 2007/0221745 | A1 | 9/2007 | Stoecklein et al. | 239/88 |
| 2011/0248101 | A1 * | 10/2011 | Jenkel | B23P 6/00 239/533.2 |
| 2014/0251276 | A1 | 9/2014 | Schürz | 123/456 |

FOREIGN PATENT DOCUMENTS

| | | | | |
|---|---|---|---|---|
| DE | 102009045348 | A1 | 4/2011 | F02M 47/02 |
| DE | 102011079468 | A1 | 1/2013 | F02M 51/06 |
| EP | 1970556 | A1 | 9/2008 | F02M 47/02 |
| WO | 2005/098229 | A1 | 10/2005 | F02M 47/02 |
| WO | 2005/108772 | A1 | 11/2005 | F02M 61/16 |
| WO | 2014/206924 | A1 | 12/2014 | F02M 1/16 |

OTHER PUBLICATIONS

German Office Action, Application No. 102013212330.2, 9 pages, dated May 8, 2014.
International Search Report and Written Opinion, Application No. PCT/EP2014/063129, 25 pages, dated Aug. 28, 2014.
Chinese Office Action, Application No. 201480036640.6. 12 pages, dated Jan. 17, 2018.

* cited by examiner

METHOD FOR PRODUCING INJECTORS, IN PARTICULAR FUEL INJECTORS

CROSS-REFERENCE TO RELATED APPLICATIONS

This application is a U.S. National Stage Application of International Application No. PCT/EP2014/063129 filed Jun. 23, 2014, which designates the United States of America, and claims priority to DE Application No. 10 2013 212 330.2 filed Jun. 26, 2013, the contents of which are hereby incorporated by reference in their entirety.

TECHNICAL FIELD

The invention relates to a method for producing a multiplicity of injectors, in particular a multiplicity of fuel injectors for direct injection systems of motor vehicles. In addition, the invention relates to a method for pairing at least two injectors and to a method for producing an injector. Furthermore, the invention relates to an injector, in particular a fuel injector for a direct injection system of an internal combustion engine.

BACKGROUND

Legal requirements which are becoming ever stricter with respect to permissible emissions of pollutants by internal combustion engines for motor vehicles make it necessary to carry out improved mixture preparation in the cylinders of the internal combustion engines by means of fuel injectors. In contemporary fuel injectors, control of the injection of fuel is carried out by means of a nozzle needle which is displaceably mounted in the fuel injector and opens or closes an opening cross section or an injection hole or a multiplicity thereof of a nozzle assembly of the fuel injector as a function of its stroke. The nozzle needle is actuated, for example, by means of a piezo-electric actuator which activates the nozzle needle hydraulically or mechanically.

In order to lower the emissions of pollutants by the internal combustion engine and to keep the consumption of said internal combustion engine as low as possible, it is desirable to achieve the best possible combustion within the cylinders of the internal combustion engine. For good process control or open-loop/closed-loop control of the combustion process in the cylinders it is necessary to be able to carry out the most precise metering possible, in terms of volume and timing, of the fuel which is to be injected, in order to achieve the best possible combustion and/or most complete possible regeneration of a particle filter of the motor vehicle at any time, since torque requirements of the internal combustion engine are converted into injection quantities which in turn correlate with an injection duration as a function of an injection pressure, a stroke of the nozzle needle and/or geometry of the fuel injector.

Deviation of an actual injection quantity from a setpoint injection quantity of a fuel injector always has adverse effects on a combustion process, that is to say on the emissions of pollutants which arise as a result, and usually also has adverse effects on the consumption of the internal combustion engine. In particular, for fuel injectors which inject directly, stringent requirements apply with respect to the accuracy of the injection quantities and the stability of a jet pattern under all operating conditions and over the entire service life of the fuel injector. This applies even more with respect to small injection quantities, in a multiple-injection mode with the associated short injection intervals and/or in a partial stroke mode of a nozzle needle.

An injection nozzle of the fuel injector is actuated by the nozzle needle which can be driven, for example, by means of a servo valve which can be actuated by means of a piezo actuator. A nozzle needle which is driven hydraulically indirectly in such a way is the state of the art. However, the nozzle needle can also be actuated directly without a detour via a servo valve. In such a fuel injector, coupling of the movement of the piezo actuator, and subsequent thereto, movement of the nozzle needle can take place hydraulically directly, which provides significant advantages. The same requirements apply to such hydraulically directly driven fuel injectors as to injection nozzles which can be actuated by means of a servo valve. However, further advantageous properties of the fuel injectors arise as a result of a hydraulic direct drive.

SUMMARY

One embodiment provides a method for producing injectors, e.g., particular fuel injectors for direct injection systems of motor vehicles, wherein the injectors are produced in such a way that a total leakage and/or a pressure difference at a transmission pin of the respective injector is approximately, mainly or essentially constant over the vast majority of the injectors.

In a further embodiment, the injectors are configured in such a way that the total leakages and/or the pressure differences at the transmission pins of the injectors is a measure of the injection quantities of the injectors.

Another embodiment provides a method for pairing at least two injectors, in particular two fuel injectors for a direct injection system of an internal combustion engine, wherein a criterion for the pairing of the at least two injectors is a total leakage and/or a pressure difference at a transmission pin of the respective injector.

In a further embodiment, the at least two injectors are paired in such a way that the total leakages and/or the pressure differences at the transmission pins of the injectors are mainly, essentially or virtually the same.

Another embodiment provides a method for producing an injector, in particular a fuel injector for a direct injection system of an internal combustion engine, wherein at least two instances of mechanical play, in particular instances of pairing play which are relevant to injection quantities, leakage quantities and/or pressure differences of the injector are paired with one another.

In a further embodiment, the pairing of the instances of mechanical play of the injector with one another is carried out in such a way that a leakage inflow to a control space of the injector corresponds essentially or at least to a leakage outflow downstream of the control space, and/or a pressure difference between a nozzle space and a control space of the injector remains essentially the same or decreases.

In a further embodiment, an instance of setpoint pairing play of an assembly of the injector is paired with an instance of actual pairing play of another assembly of the injector, wherein, if appropriate, an instance of nominal pairing play of the paired assembly is taken into account.

In a further embodiment, an instance of mechanical play has two other instances of mechanical play paired with it, wherein the two other instances of mechanical play are preferably also paired with one another.

In a further embodiment, in addition to an assembly which is already installed on/in an existing injector and which has actual pairing play, it is possible to install at least one assembly which has paired setpoint pairing play, on/in the existing injector.

In a further embodiment, the instances of mechanical play of a nozzle needle in a guide of the nozzle needle, a transmission pin in an intermediate plate and/or a control piston in a control plate are paired with one another.

In a further embodiment, the pairing of the instances of mechanical play for an injector is carried out on the basis of at least one test point and/or at least one test series for individual assemblies or components which are mounted one against the other.

In a further embodiment, a respective instance of mechanical play is determined by measuring the gas leakage, by measuring the throughflow rate, by determining the diameter and/or by determining the shape; the method is carried out chronologically after separate premounting of at least two individual assemblies; the pairing of the at least two individual assemblies is taken into account for final assembly of an injector; the method is carried out when final assembly of the injector takes place; and/or the injector is embodied according to any of the embodiments discussed above.

Another embodiment provides an injector, e.g., fuel injector for a direct injection system of an internal combustion engine, wherein at least two instances of mechanical play, in particular instances of pairing play which are relevant to injection quantities, leakage quantities and/or pressure differences of the injector are paired with one another.

In a further embodiment, the instances of mechanical play of a nozzle needle in a guide of the nozzle needle, a transmission pin in an intermediate plate and/or a control piston in a control plate are paired with one another.

In a further embodiment, the injector is free of a control valve or servo valve which actuates the injection quantities of the injector; an actuator of the injector is a piezo actuator; and/or the injector is produced with a production method as discussed above.

BRIEF DESCRIPTION OF THE DRAWINGS

Example embodiments of the invention are explained in more detail below with reference to the drawings, in which.

DETAILED DESCRIPTION

Figure 1:
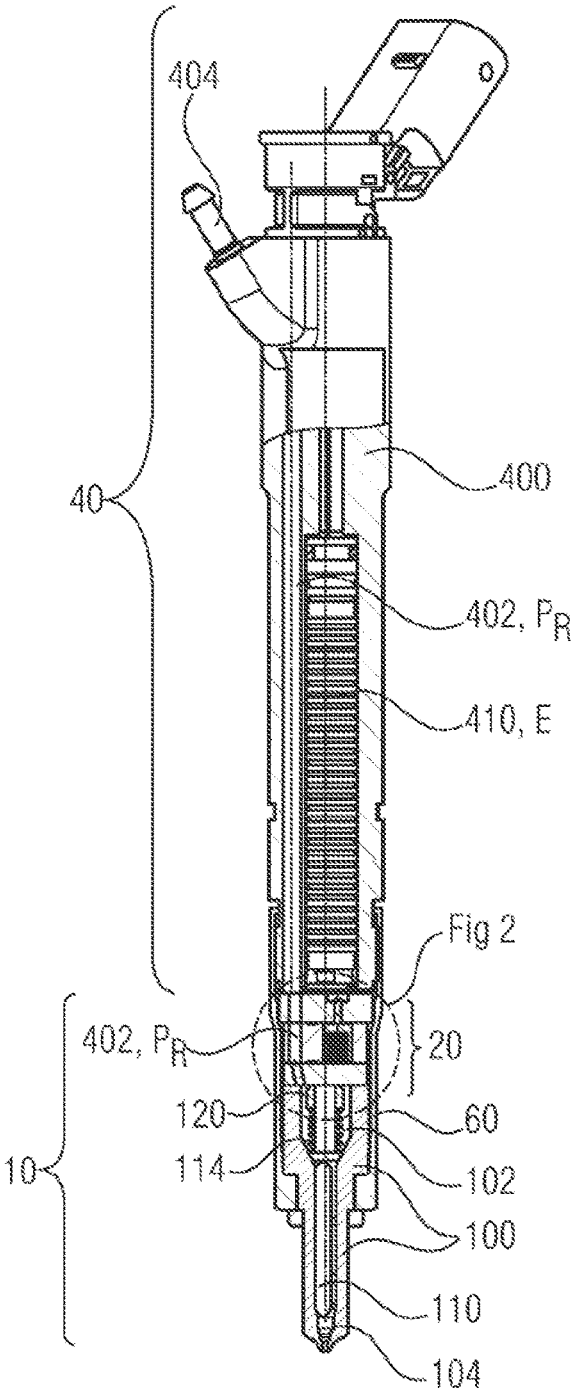
FIG. 1 shows a longitudinal side view of an injector according to an embodiment of the invention for a common-rail injection system of an internal combustion engine, which view is illustrated in section centrally and at the bottom in the center.

Embodiments of the invention provide, e.g., for hydraulically directly driven injectors, an improved production method with a criterion for the vast majority of the injectors. Other embodiment provide an improved method for pairing at least two injectors. Still other embodiment provide an improved method for producing an injector and a correspondingly improved injector, in particular a fuel injector. In this context, a reduced or minimized degree of variation between the injection quantities of the injectors may be ensured, at least in their new state.

Some embodiments provide a method for producing injectors, in particular fuel injectors, for direct injection systems of motor vehicles; a method for pairing at least two injectors, in particular two fuel injectors for a direct injection system of an internal combustion engine; a method for producing an injector, in particular a fuel injector; and an injector.

In order to provide, with an injector concept with a nozzle needle which can be activated hydraulically directly, a reduced or minimized degree of variation between the injection quantities at operating points or test points and/or in operating ranges or test ranges of the injectors, at least in their new state, it has proven effective to set a balance between the leakage flows or leakage quantities and/or specific pressure differences within a nozzle assembly and/or control assembly of an individual injector as precisely as possible and/or to maintain, that is to say set, as precisely as possible said balance over a multiplicity of injectors, for example the injectors of an individual injection system, or over a multiplicity of injectors, for example the injectors of one production batch, wherein the production tolerances must not be too low, in order to avoid raising costs too much.

Some embodiments provide a method for producing injectors, that is to say for example one production batch of injectors, the injectors are adjusted or produced in such a way that a total leakage and/or a pressure difference at a transmission pin of the respective injector is approximately, mainly or essentially constant over, if appropriate, the vast majority of the injectors. In this context, the injectors can be embodied in such a way that the total leakages and/or the pressure differences at the transmission pins of the injectors are a measure of the injection quantities and/or injection accuracies of the injectors.

That is to say the criterion for the production of a multiplicity of injectors is, for example in addition to reproducible injection quantities, the approximately, mainly or essentially constant total leakages, for example total leakage flows and/or total leakage quantities of said injectors with respect to one another, and/or their approximately, mainly or essentially constant pressure differences, with respect to one another, at their transmission pins. This criterion can be, for example, a secondary condition for the injection quantities. In this context it is preferred if the total leakages which are as far as possible constant with respect to one another and/or pressure differences which are as far as possible constant with respect to one another apply to a multiplicity of operating points or test points and/or operating ranges or test ranges of the injectors.

Other embodiments provide a method for pairing at least two injectors, a criterion for the pairing of the injectors is a total leakage and/or a pressure difference at a transmission pin of the respective injector. In this context, the injectors can be paired in such a way that the total leakages and/or the pressure differences at the transmission pins of the injectors are mainly, essentially or virtually the same. That is to say a device for injecting fuel, for example in an injection system for an internal combustion engine, has at least two injectors. The injectors are selected in such a way that they have, at at least one operating point or test point and/or in at least one operating range or test range, a total leakage and/or pressure difference that are mainly, essentially or virtually the same with respect to one another, at their transmission pins.

The terms "approximately", "mainly", "essentially" or "virtually" which qualify the corresponding measured values and/or calculated values for the total leakages and/or pressure differences are intended to be able to be categorized in the following decreasing sequence: (clearly) different (for example at least multiplication by ten or a tenth), roughly, approximately, mainly (not more than double or less than half), essentially, virtually, identical (up to one or two customary decimal places, i.e., within 10%). The respectively preceding term, that is to say for example the term "virtually" is intended here to include the following term, that is to say in this example the term "identical".

Other embodiments provide a method for producing an injector, at least two, preferably three, instances of mechanical play, in particular instances of pairing play which are relevant to injection quantities, leakage quantities and/or pressure differences of the injector, are matched to one another, in particular paired with one another. The adjustment or the pairing of the instances of mechanical play of the injector with respect to one another or with one another can be carried out in such a way that a leakage inflow to a control space of the injector corresponds essentially or at least to a leakage outflow downstream of this control space. In addition, it is possible for a pressure difference between a nozzle space and a control space of the injector to remain essentially the same or to decrease. This can alternatively or additionally also be applied to a pressure difference between the control space, or a control space, and a leakage space of the injector.

In some embodiments, an instance of setpoint pairing play of an assembly of the injector can be paired with an instance of actual pairing play of another assembly of the injector, wherein, if appropriate, an instance of nominal pairing play of the paired assembly is taken into account. In this context, two or more different instances of mechanical play can be paired in one instance of mechanical play, wherein the two or more different instances of mechanical play can preferably also be matched to one another or paired with one another. This can be carried out, for example, as described herein. That is to say, for example, three instances of mechanical play can be matched to one another or paired with one another, which is preferably carried out successively or in parallel.

If this takes place successively, a second instance of play which is preferably as good as possible is paired with a first instance of mechanical play, with which second instance of play a third instance of play, which is preferably as good as possible, is then paired. It is also possible to pair the second and third instances of play together in addition to the first instance of play. In the latter embodiment, an instance of play which is, for example, too small, i.e. possibly damaging, can be avoided. This is possible, of course, also in the first embodiment as long as the third instance of play is taken into account as a secondary condition when the second instance of play is set up, or vice versa. This procedure is, of course, also applicable to two, four or more instances of mechanical play of the injector which are in a causal relationship with one another.

In some embodiments, in addition to an assembly which is already installed on/in an existing injector and which has actual pairing play, it is possible to install at least one assembly which has setpoint pairing play which is paired therewith on the existing injector. That is to say an assignment of an instance of setpoint pairing play of a second assembly to the instance of actual pairing play of a first assembly or of the injector which is already partially present preferably follows mounting of the injector such that mounting which is built up successively one on top of the other occurs. That is to say it is preferably possible to construct the injector as before in such a way that a component which has already been mounted does not have to be removed again in order to be able to set a respective instance of play or carry out pairing.

According to embodiments of the invention, for example the instances of mechanical play of a nozzle needle in a guide of the nozzle needle, for example a nozzle needle sleeve, a transmission pin in an intermediate plate and/or a control piston in a control plate can be set with respect to one another or paired with one another. Other components or assemblies can, of course, be used. The setting or pairing of the instances of mechanical play with respect to one another for an injector can be carried out on the basis of at least one test point and/or at least one test series for individual assemblies or assemblies or components which are mounted one against the other. That is to say measured values for pressures, leakages, dimensions and/or other parameters can be determined for one test point and/or test series, or for a multiplicity thereof, for a respective individual assembly or for assemblies or components which are to be mounted one against the other, for a hypothetical injector.

In some embodiments, a respective instance of mechanical play, that is to say an instance of actual pairing play, can be determined by measuring the gas leakage, by measuring the throughflow rate, by determining the diameter and/or by determining the shape. The method can be carried out chronologically after separate premounting of at least two individual assemblies. The setting with respect to one another, or pairing with one another, of the at least two individual assemblies may be taken into account for final assembly of an injector. In addition, the method can be carried out during final assembly of the injector. Furthermore, the injector can be embodied as an injector according to the invention (see below).

In some embodiments of the injector, e.g., a fuel injector, at least two instances of mechanical play, in particular instances of pairing play which are relevant to injection quantities, leakage quantities and/or pressure differences of the injector, are matched to one another, in particular paired with one another. The instances of mechanical play which are set with respect to one another or paired with one another can be, for example, those of a nozzle needle in a guide of the nozzle needle, for example a nozzle needle sleeve, a transmission pin in an intermediate plate and/or a control piston in a control plate. The injector is preferably free of a control valve or servo valve which actuates the injection quantities of the injector. An actuator of the injector is preferably a piezo actuator. In addition, the injector can be produced with a method as disclosed herein.

According to embodiments the invention, it is possible to configure or produce a good to very good, i.e. as good as possible, combination of instances of pairing play for the component pairings with comparatively low outlay during the assembly of an injector. An injector/injector variation may be reduced during assembly of the injectors by virtue of the fact that within an assembly process of the injectors functionally relevant instances of pairing play for outflowing leakage, on the one hand, and inflowing leakage, on the other, are suitably matched to one another. Therefore, the variation in series production with respect to an injector function is decreased, and a portion of those injectors which do not comply with required tolerances of their injection quantities can be reduced. It is therefore also possible to reduce the outlay on necessary subsequent work. This has individual and global effects in reducing the manufacturing costs.

Example aspects and embodiments of the invention are explained in more detail below with reference to a piezo-electrically operated common-rail diesel injector 1 for an internal combustion engine of a motor vehicle (see FIG. 1). Embodiments of the invention are, however, not restricted to such diesel injectors 1 but rather can, for example, also be applied to pump-nozzle-fuel injectors or gasoline injectors with a single-part or multi-part nozzle needle, and typical designations for gasoline injectors can be found in the list of reference symbols. Therefore, only an injector 1 is discussed below. An injectable fluid can be a fuel, but it is, of course, also possible for another fluid such as, for example, water or an oil or any other process fluid, to be injected by means of an injector as disclosed herein. That is to say the injector according to embodiment of the invention is not restricted to the automobile industry.

FIG. 1 shows the injector 1 essentially in a sectional image, wherein the injector 1 comprises a nozzle assembly 10 and an injector assembly 40. The nozzle assembly 10 and the injector assembly 40 are fixed to one another in a fluid-tight fashion by means of a nozzle clamping nut 60. The injector assembly 40 has an injector body 400 in which an actuator 410, which is preferably embodied as a piezo actuator 410, is provided.

However, an electromagnetic actuator can also be used. In the present example, the piezo actuator 410 drives a single-part, preferably integral, nozzle needle 110 in a hydraulically direct fashion (see also FIG. 2). The single-part, inwardly opening nozzle needle 110 can, if appropriate, be embodied with two parts or multiple parts and/or be configured to open outward in the injector 1.

The injector body 400 has a high-pressure-side fluid port (not shown) for the fuel which is to be injected, wherein the fuel port communicates fluidically with a high-pressure bore 402 which is formed in the injector body 400. The injector 1 can be connected hydraulically to a high-pressure fluid circuit (not illustrated) via the high-pressure-side fluid port. The high-pressure bore 402 supplies the nozzle assembly 10, and therefore a nozzle space 102 of the injector 1 with fuel at high pressure $p_R$, for example what is referred to as a rail pressure $p_R$ (common-rail system). In the nozzle space 102 there is essentially always a current high pressure or maximum pressure $p_{102}=p_R$ during operation of the injector 1.

The nozzle assembly 10 has a nozzle body 100 with at least one spray hole (not illustrated) in its nozzle 104 and the nozzle space 102, wherein the nozzle needle 110 is arranged displaceably, and partially mounted, in the nozzle space 102. The nozzle needle 110 is pressed by an energy storage means 114, preferably a nozzle needle spring 114, in the direction of its nozzle needle seat, inward in the nozzle 104, in order also to be reliably closed in an electrically non-energized state of the piezo actuator 410. Depending on actuation of the piezo actuator 410, the nozzle needle 110 is either pressed into its nozzle needle seat or moved away from the nozzle needle seat, as a result of which fuel can be injected.

Figure 2:
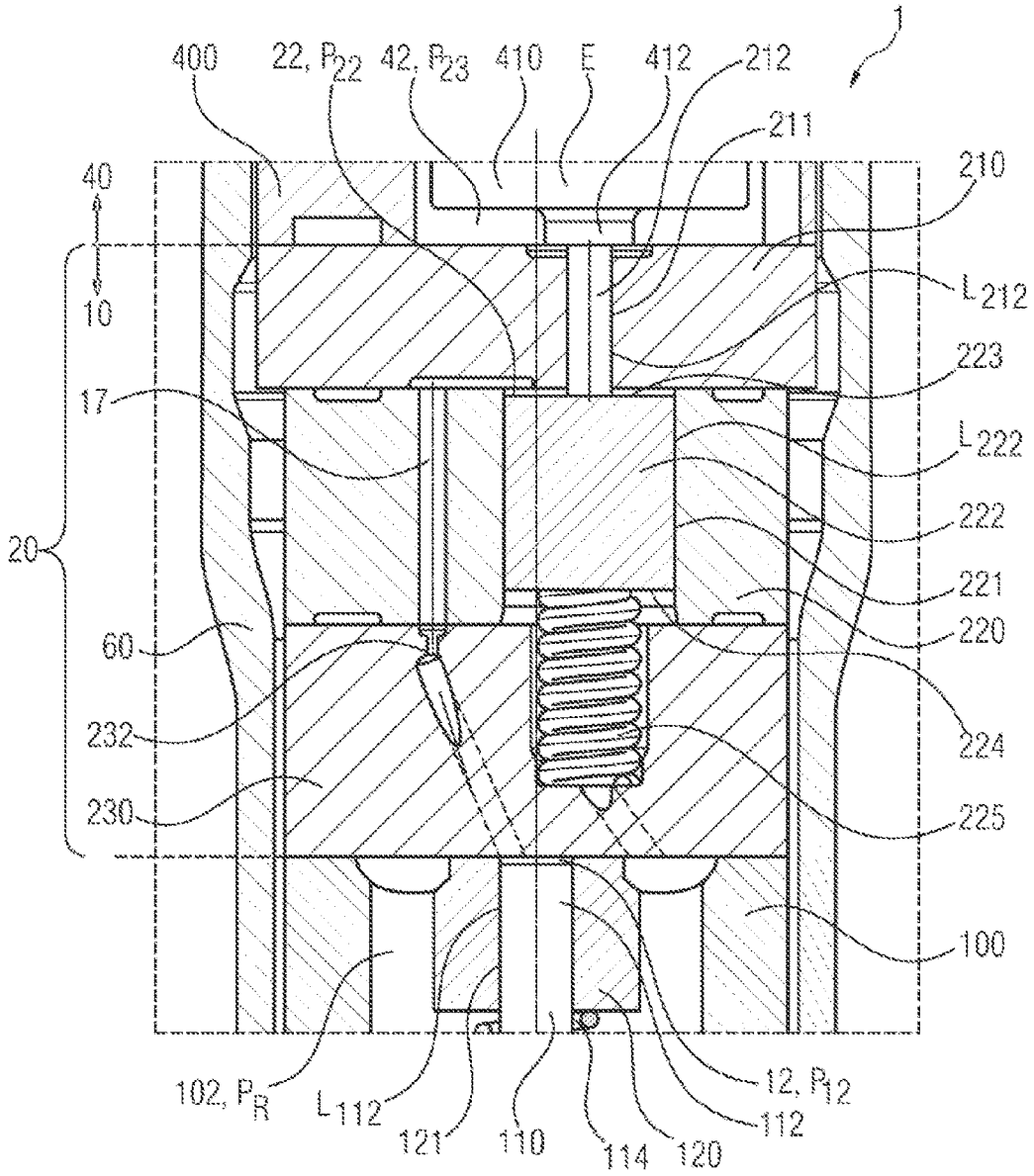
FIG. 2 shows a detailed longitudinal side view, illustrated in section centrally and cut away at the top and the bottom, of a control assembly of the injector from FIG. 1 having hydraulic direct drive of a nozzle needle.

The nozzle assembly 10 also accommodates a control assembly 20, located between the nozzle body 100 and the injector assembly 40, for actuating the nozzle needle 110 on the basis of lengthening of the piezo actuator 410 as a function of its energy E or charge E, that is to say an electrical voltage which is applied thereto. FIG. 2 shows the components of the control assembly 20 for direct hydraulic coupling of a longitudinal movement of the piezo actuator 410 and of a movement of the nozzle needle 110 which is caused thereby. The piezo actuator 410 has for this purpose a baseplate 412 with a preferably integral actuation projection which is in direct mechanical contact with a transmission pin 212, which is fitted in and/or paired with a pin bore 211 of an intermediate plate 210 of the control assembly 20 with very little play.

An instance of pairing play of the transmission pin 212 in the pin bore 211 is selected to be small, for example approximately 1 μm, such that only a small fuel leakage L occurs (dripping) at the transmission pin 212 even in the case of a high rail pressure $p_R$ over 2,500 bar. The pin bore 211 connects here a first control space 22, which is also referred to as a piston control space 22 and in which a somewhat lower fuel pressure than the current rail pressure $p_R>p_{22}$ is present, to a leakage space 42 of the injector 1, which preferably has permanent fluidic communication with an ambient pressure $p_\infty$. The leakage space 42 preferably communicates fluidically with a leakage port 404 of the injector 1. A large pressure difference $\Delta p=p_{22}-p_\infty$, which can, for example, easily exceed a value of 2,450 bar given the 2,500 bar maximum pressure assumed above and a connected injector 1, is present at the transmission pin 212.

The first control space 22 preferably has a permanent fluidic connection with a second control space 12, referred to as the needle control space 12, through a connecting bore 17 through a section of the control assembly 20. In the second control space 12 there is, as in the first control space 22, a somewhat lower fuel pressure than rail pressure $p_R>p_{12}$, wherein the pressures $p_{12}\approx/=p_{22}$ in the control spaces 12, 22 are essentially the same, at least when the injector 1 is closed. Overall, the following applies: $p_\infty=p_{42}<<p_{12}\approx/=p_{22}\leq p_R=p_{102}$. In the connecting bore 17 it is possible to provide a damping restrictor 232 which is embodied as a fluid restrictor 232 and is preferably formed in a separate plate 230 of the control assembly 20.

A stroke (lengthening) of the piezo actuator 410 is transmitted by means of the transmission pin 212, which is also referred to as a leakage pin 212, to a control piston 222 which is fitted in, and/or paired with, a piston bore 221 of a control plate 220 of the control assembly 20. The transmission pin 212 engages on or in the first control space 22 at an upper end face 223 of the control piston 222, wherein the control piston 222 is supported on its lower end face 224 by an energy storage means 225 which is preferably embodied as a helical spring 225. Essentially rail pressure $p_R$ is preferably present at the lower end face 224 of the control piston 222, wherein this end face 224 preferably has a permanent fluidic communication with the nozzle space 102.

The second control space 12 is formed by an end face of an upper longitudinal end section 112 of the nozzle needle 110, referred to as the needle piston 112, of a wall of a needle bore 121 in an upper guide 120 of the nozzle needle 110, preferably a nozzle needle sleeve 120, and a lower end face of the plate 230. The needle piston 112 of the nozzle needle 110 faces away from a nozzle needle tip of the nozzle needle 110 or of the nozzle 104 of the nozzle body 100 here. This briefly presented embodiment of the injector 1 is, of course, not to be understood restrictively. Embodiments of invention are applicable to a multiplicity of other embodiments of injectors as long as a leakage L and/or a pressure drop Δp within the injector can be used as a quality measure for the injector.

As a result of the movement of the control piston 222 owing to a stroke of the piezo actuator 410, a pressure drop $\Delta p_{22}$ is generated in the first control space 22, which pressure drop $\Delta p_{22}$ is transmitted to the upper end face of the nozzle needle 110 in the second control space 12 via the connecting bore 17 and, if appropriate, with a delay by the optional fluid restrictor 232. If this pressure drop $\Delta p_{12} \approx / = \Delta p_{22}$ exceeds a specific value, the nozzle needle 110 opens and fuel can be injected. A stroke of the nozzle needle 110 can be open-loop/closed-loop controlled starting from opening of the nozzle needle 110, by varying the stroke of the piezo actuator 410. The stroke of the piezo actuator 410 can be varied by means of a variation of its intrinsic electrical energy E, that is to say the voltage applied to it.

The piezo actuator 410 shortens when it is discharged, and the rail pressure $p_R$, acting on/at the lower end face 224 of the control piston 222 from the nozzle space 102 of the nozzle body 100, together with the spring force of the spring element 225 which also acts in this direction, the control piston 222 is pushed back into its initial position which is determined by a position of the transmission pin 212. As a result, the nozzle needle 110 is shifted back into its closed position, in a way corresponding to the movement of the piezo actuator 410, and the injection of fuel is ended. The nozzle needle spring 114 keeps the nozzle needle 110 securely closed at/on its seat in the nozzle 104 of the nozzle body 100.

The injector 1 has three internal leakages L or leakage flows L or quantities L here. Firstly, a leakage $L_{112}$ at the nozzle needle 110 or the needle piston 112 thereof, that is to say between the nozzle needle sleeve 120 and the needle piston 112 through the needle bore 121. This is a leakage inflow $L_{112}$ into the second control space 12 directly downstream of the nozzle needle 110. And as a second leakage inflow $L_{222}$, a leakage $L_{222}$ at a control piston 222, that is to say between the control plate 220 and the control piston 222 through the piston bore 211. This is a leakage inflow $L_{222}$ into the first control space 22 directly downstream of the control piston 222. A leakage $L_{212}$ occurs as a leakage outflow $L_{212}$ or a total leakage $L_{212}$ of the injector 1 at the transmission pin 212, that is to say between the intermediate plate 210 and the transmission pin 212 through the pin bore 211 into the leakage space 42.

The leakage balance of the inner leakages $L_{122}$, $L_{212}$, $L_{222}$ of the injector 1 with respect to the transmission pin 212 occurs as $L_{212}=L_{122}+L_{222}$ over a relatively long time period. A leakage L is always the result of a pressure difference Δp of the fuel at/in a component or at/in an assembly here. Leakages L and/or pressure differences Δp within the nozzle assembly 10 and/or the control assembly 20 may be paired or set, i.e. corresponding components and/or assemblies are paired in the sense of a selection pairing, which is explained in more detail below. In particular, the components which are themselves preferably matched to one another and/or paired with one another: the transmission pin 212 and intermediate plate 210, control piston 222 and control plate 220 as well as nozzle needle 110 or needle piston 112 and nozzle needle sleeve 120 form three such assemblies.

If the nozzle needle 110 is closed, as a result of the leakage $L_{212}$ at the transmission pin 212—the fuel pressure in a downstream leakage path to the leakage port 404 corresponds approximately to the ambient pressure $p_\infty$ (see above)—there is also an outflow of fuel from the first control space 22, which leads to a pressure drop Δp in the first control space 22 to the pressure $p_{22}$. This leakage outflow $L_{212}$ is compensated by a leakage inflow $L_{112}+L_{222}$ in the nozzle needle sleeve 120 and at the control piston 222. A pressure difference $\Delta p=p_R-p_{12}$ or $\Delta p=p_R-p_{22}$ between the pressure $p_{12}$, $p_{22}$ in the control space 12, 22 and the rail pressure $p_R$ acts as a driving force for this leakage inflow $L_{112}+L_{222}$. Therefore, the control piston 222 is fitted into the piston bore 221, and an upper diameter of the nozzle needle 110 is fitted into the nozzle needle sleeve 120 with an instance of pairing play to be defined.

Owing to the leakage balance $L_{212}=L_{122}+L_{222}$ described above a pressure difference Δp arises between the rail pressure $p_R$ and a pressure $p_{12}$, $p_{22}$ in the respective control space 12, 22 directly from the instances of play which are set at the transmission pin 212, at the control piston 222 and in the nozzle needle sleeve 120, these being, in particular, instances of pairing play between selection pairings. Such an initial pressure difference Δp results in reduction of a closing force acting on the nozzle needle 110 and therefore influences an opening time and also a closing time of the injector 1. The three instances of play result in an influence on the metering accuracy of the injector 1. In order to reduce this influence on the injection quantities of the injector and in order to achieve low injector/injector variation, a combination of the instances of pairing play before or during assembly of the injectors 1 is optimized, i.e. improved, as disclosed herein. This is explained by way of example below.

The outflowing leakage $L_{212}$ is defined essentially by means of the instance of pairing play between the transmission pin 212 and the intermediate plate 210. Since it is currently still costly to detect with sufficient geometric precision shaped tolerances of the pin bore 211 in the intermediate plate 210 and the transmission pin 212, it is also possible, for example, to determine an integral value relating to an expected leakage outflow $L_{212}$, for example by means of measurement of gas leakage during the assembly, a pre-assembly and/or a test assembly. This expected value of the leakage outflow $L_{212}$ defines setpoint values $\Delta d_{setp}$ of the instances of pairing play for the control piston 222 in the control plate 220 and the needle piston 112 in the nozzle needle sleeve 120.

In a subsequent assembly step, the control piston 222 of the control plate 220 or the piston bore 211 thereof are paired. A resulting instance of actual pairing play $\Delta d_{act}$ can differ from the instance of setpoint pairing play $\Delta d_{setp}$ within the scope of a permitted tolerance. In order to arrive as precisely as possible at a target control space pressure $\Delta_{12} \approx / = \Delta p_{22}$ in order to achieve a leakage equilibrium (outflowing leakage $L_{212}$=sum of the inflowing leakages $L_{122}$, $L_{222}$) a setpoint value $\Delta d_{setp}$ of the instance of pairing play for the nozzle needle 110 in the nozzle needle sleeve 120 is to be selected as a function of the instance of actual pairing play $\Delta d_{act}$ of the control piston 222 in the control plate 220.

Given the predefined pressure difference Δp and the viscosity of the fuel, a throughflow of fuel through an ideal annular gap is proportional to the diameter of an annular gap multiplied by the gap dimension to the power of three divided by the gap length. Eccentricity of clearance fits can influence the resulting throughflow of fuel in the range of a factor from 0.5 to 2.5. This parameter can, where necessary, be taken into account, for example, on a statistical basis. On the basis of this relationship, it is possible to determine, i.e. calculate, the setpoint value $\Delta d_{setp}$ of the instance of pairing play of the nozzle needle sleeve 120 with respect to the nozzle needle 110 as a function of a deviation of the instance of play of the control piston 222 from the setpoint value $\Delta d_{setp}$. The following formula for the instance of setpoint pairing play $\Delta d_{120_setp}$ of the nozzle needle sleeve 120, that is to say of the nozzle needle 110 or the needle piston 112 thereof, in the nozzle needle sleeve 120 or the needle bore 121 is obtained:

$$\Delta d_{120_step} = 3\sqrt{\frac{l_{120} \cdot d_{222}}{l_{222} \cdot d_{120}} \cdot (\Delta d^3_{222_norm} - \Delta d^3_{222_act}) + \Delta d^3_{120_norm}}$$

with the variables:

$l_{120}$ a length of the nozzle needle sleeve 120;

$d_{222}$ a diameter of the control piston 222;

$l_{222}$ a length of the control piston 222;

$d_{120}$ an internal diameter of the nozzle needle sleeve 120;

$\Delta d_{222_norm}$ an instance of nominal pairing play of the control piston 222, that is to say the control piston 222 in the control plate 220 or the piston bore 221 thereof;

$\Delta d_{222_act}$ an instance of actual pairing play of the control piston 222, that is to say the control piston 222 in the control plate 220 or the piston bore 221 thereof; and $\Delta d_{120_norm}$ an instance of nominal pairing play of the nozzle needle sleeve 120, that is to say the nozzle needle 110 or the needle piston 112 thereof in the nozzle needle sleeve 120 or the needle bore 121 thereof.

Figure 3:
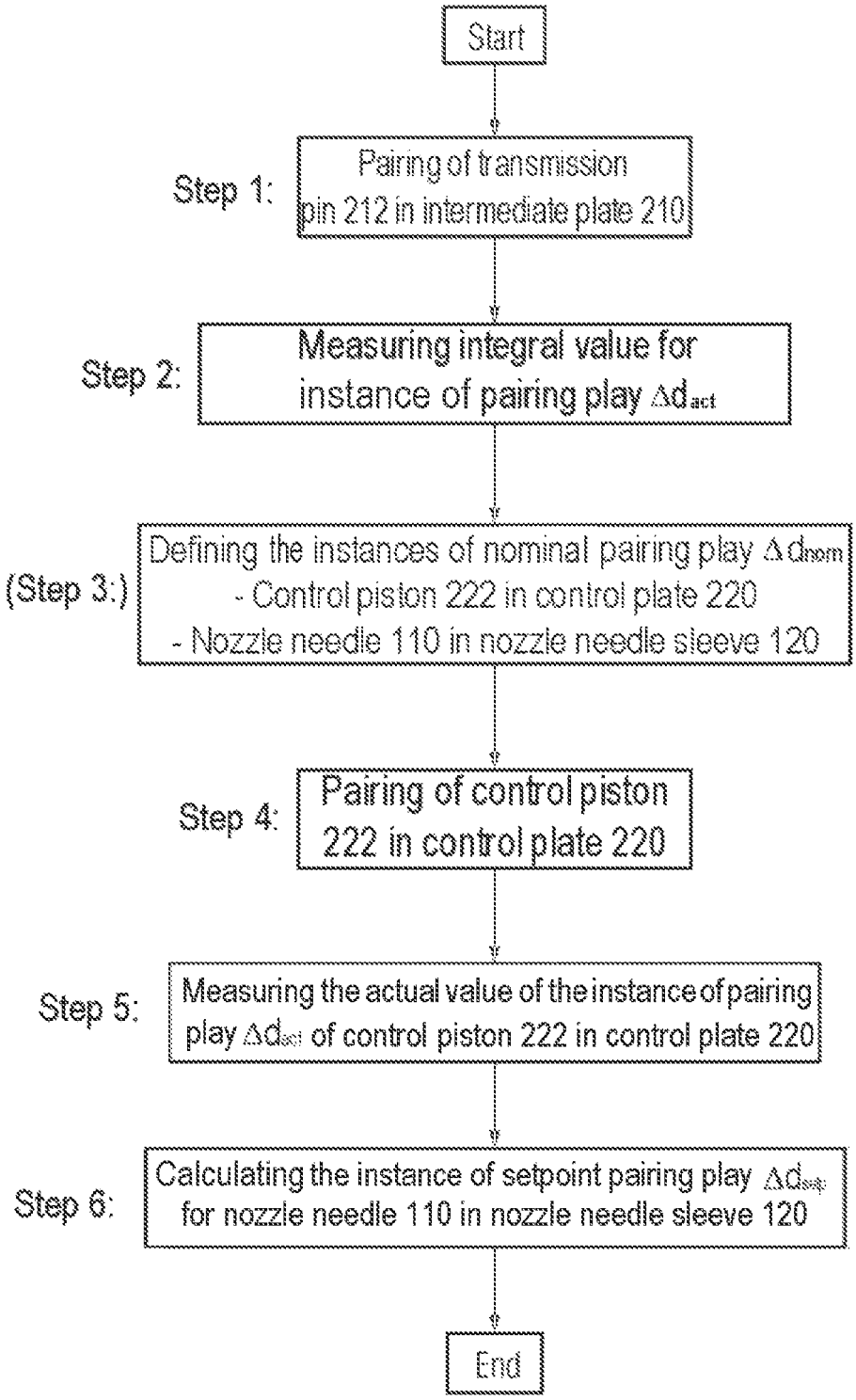
FIG. 3 shows a flowchart of an embodiment of a method according to the invention for matching to one another, or pairing with one another, three instances of mechanical play within a nozzle assembly of the injector.
Figure 4:
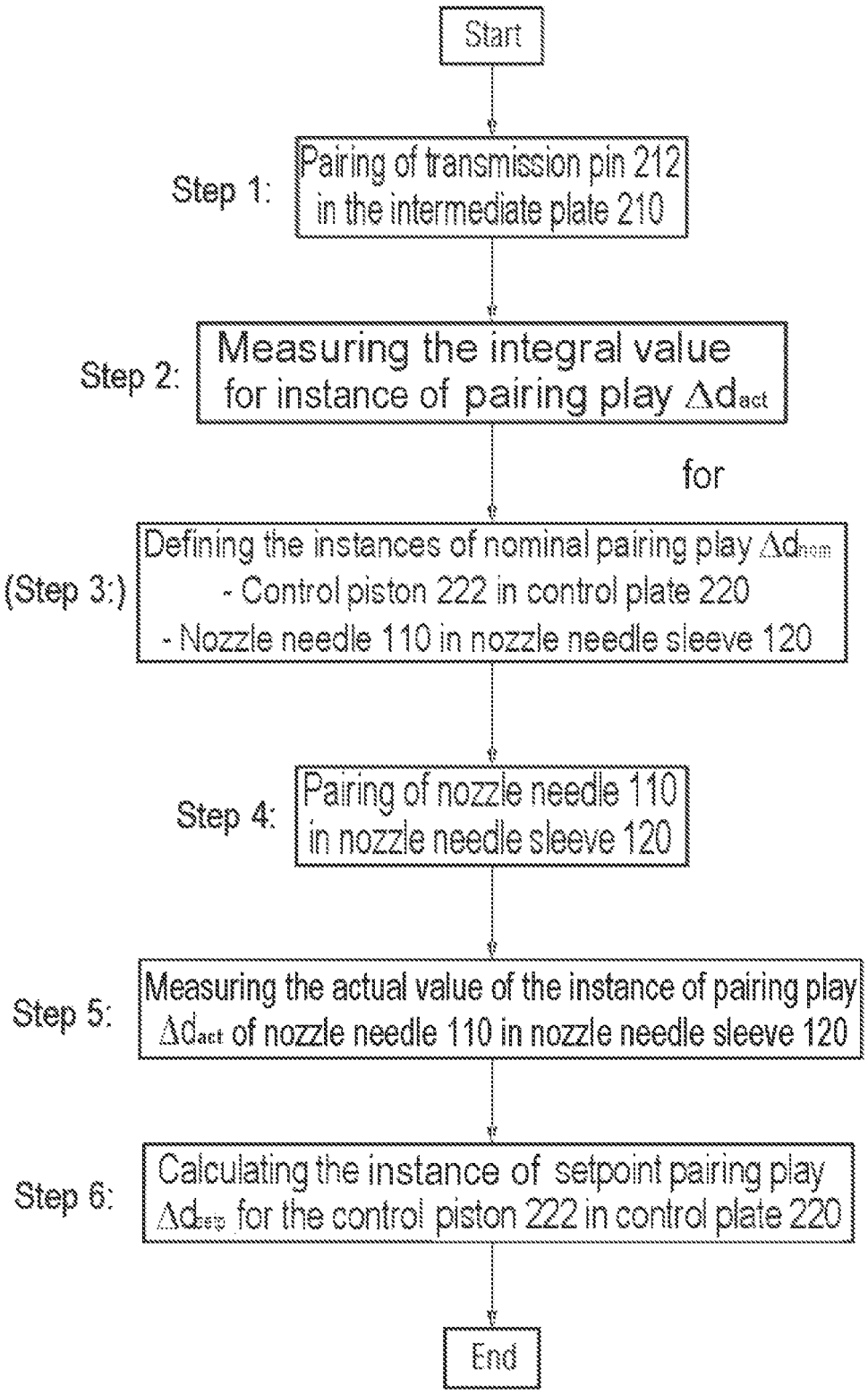
FIG. 4 shows a flowchart which is analogous to that in FIG. 3 and which represents a second embodiment of the method according to the invention during the matching to one another, or pairing with one another, of the three instances of mechanical play.
Figure 5:
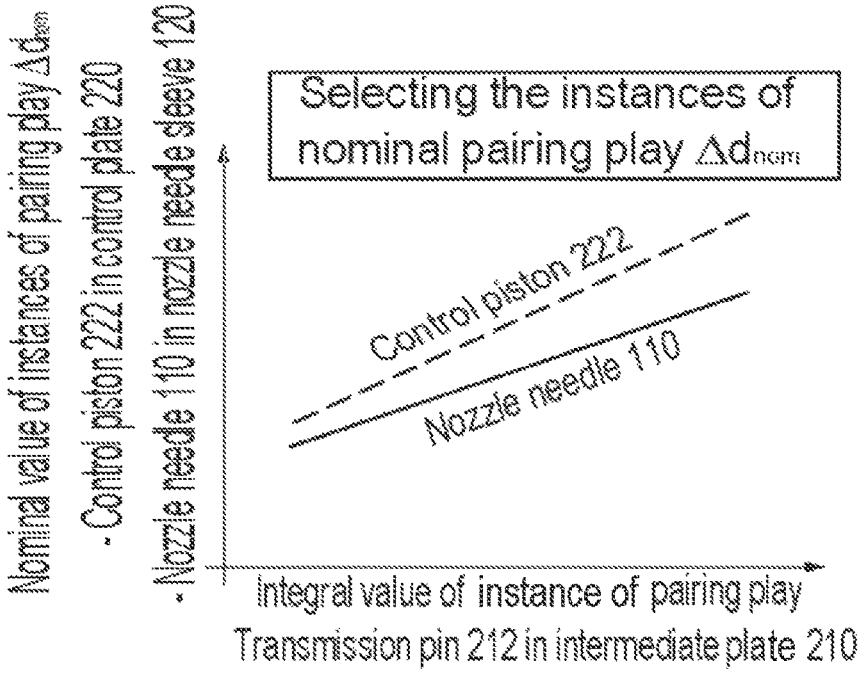
FIG. 5 shows a schematic diagram according to FIGS. 3 and 4 relating to the selection of a second and third instance of mechanical play on the basis of an actual value of a first instance of mechanical play.

FIG. 3 illustrates this method according to one embodiment of the invention in the form of a flowchart. The applied method can also be applied in a reverse order, with the result that the instance of play at the nozzle needle sleeve 120 (other instance, or second instance, of mechanical play) is used as the initial parameter and an instance of play which is to be set at the control piston 222 (other instance, or third instance, of mechanical play) is calculated therefrom, which is illustrated in the flowchart in FIG. 4. FIG. 5 shows a diagram, analogous to FIGS. 3 and 4, for selecting the second or third instances of mechanical play on the basis of the actual value of a first instance of mechanical play at the transmission pin 212 (initial instance of mechanical play). In principle it is possible to apply any of the three instances of play as initial instances of play and to set the two other instances of play, again in any order, that is to say to pair the respective assemblies.

In addition, the calculation can be simplified, for example, to the effect that a setpoint value $\Delta d_{setp}$ for a sum (of the instances of pairing play) is determined on the basis of the instance of pairing play at the control piston 222 and the instance of pairing play in the nozzle needle sleeve 120, as a function of the instance of actual pairing play $\Delta d_{act}$ of the transmission pin 212 in the intermediate plate 210 or the measured value on the basis of the measurement of the gas leakage. The instance of setpoint pairing play $\Delta d_{setp}$ for the nozzle needle 110 in the nozzle needle sleeve 120 is obtained from the difference between the defined sum of the instances of pairing play and a determined instance of actual pairing play $\Delta d_{act}$ of the control piston 222 in the control plate 220. It is therefore also possible to prevent both instances of pairing play from settling at an upper tolerance limit or lower tolerance limit, which brings about undesired effects.

Figure 6:
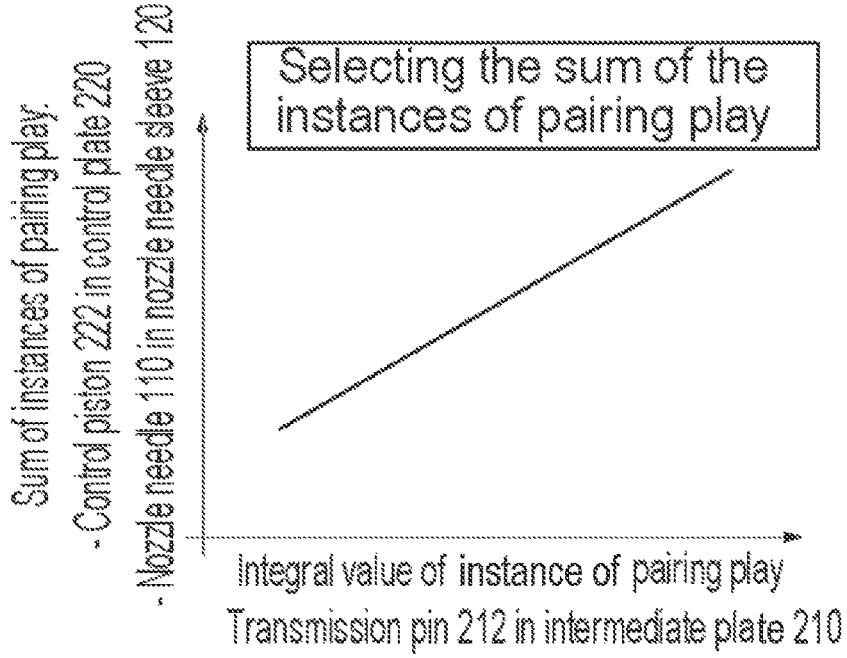
FIG. 6 shows a schematic diagram of a method which is simplified according to the invention, wherein a sum of the second and third instances of mechanical play is paired with the actual value of the first instance of mechanical play.

FIG. 6 illustrates this method schematically. The order of the instance of pairing play of the control piston 222 in the piston bore 221 and the instance of pairing play of the needle piston 112 in the nozzle needle sleeve 120 can also be reversed here. Since, in particular, excessively low instances of pairing play for the inflowing leakage $L_{122}+L_{222}$ result in deviations in the injection quantities of the injector 1, a further simplified criterion can be applied in the form that the sum of the instance of pairing play at the control piston 222 and in the nozzle needle sleeve 120 has to be greater than a setpoint value (for example as a function of a result of the measurement of the gas leakage described above at the transmission pin 212). That is to say, a correction takes place only if this setpoint value is undershot; for example as a result of the provision of a nozzle assembly 10 with a comparatively large amount of pairing play between the nozzle needle 110 or the needle piston 112 thereof and the nozzle needle sleeve 120.

According to embodiments of the invention, at least two assemblies of the injector 1 are paired with one another, wherein at least one of these assemblies is itself a result of a pairing of two components of this assembly. Therefore, pairings are formed, i.e. paired components, specifically those of the first assembly, are paired in addition to paired components, specifically those of the second assembly, in such a form that the pairing of the second assembly is configured, i.e. pairing is carried out, with respect to the pairing of the first assembly. All the pairings can be considered to be selection pairings. These pairings interact here, at least temporarily, in terms of fluid mechanics in the injector in such a way that a throughflow of fuel through the first "pairing" influences a throughflow of the fuel through the second "pairing".

The pairing of pairs can, of course, also be applied to three (see above) or more assemblies which can be composed of paired components. In addition, instead of pairing a single component with an assembly, which component can be referred to in such a case as an assembly, it is also possible to pair with an assembly composed of components which are already paired. A sequence of the pairing of assemblies, that is to say the pairings of pairs, can in principle be carried out in any desired way, wherein an initial assembly is preferably paired as far as possible nominally with respect to its throughflow of fuel. The initial assembly is preferably that assembly which is the first of the assemblies which are to be paired with one another to be mounted on the injector 1.

A preferred initial assembly is therefore the transmission pin 212 in the pin bore 211 of the intermediate plate 210. The further pairing is then preferably carried out with progressive building up of the injector 1 in such a form that assemblies which have already been mounted preferably no longer have to be removed. A respective partial injector (1) determines the pairing of the assembly or assemblies or component or components still to be mounted, on the basis of the measured, calculated and/or estimated leakage behavior of said partial injector (1). Other sequences of the pairing or of the process of assembling the injector 1 can, of course, be applied.

LIST OF REFERENCE SYMBOLS

| | |
|---|---|
| 1 | Injector, fuel injector, common-rail/piezo fuel injector, pump-nozzle-fuel injector, diesel injector, gasoline injector |
| 10 | Nozzle assembly, injection module |
| 12 | Second control space, needle control space, $p_{12}$ |
| 17 | Connecting bore/line between the first control space 22 and second control space 12 |
| 20 | Control assembly of the nozzle assembly 10 for actuating the nozzle needle 110 |
| 22 | First control space, piston control space, $p_{22}$ |
| 40 | Injector assembly, drive module |
| 42 | Leakage space (total leakage $L_{212}$ preferably only at the transmission pin 212), $p_{42}$ |

-continued

| | |
|---|---|
| 60 | Nozzle clamping nut, valve clamping nut |
| 100 | Nozzle body |
| 102 | Nozzle space, nozzle bore, $p_{102}$ |
| 104 | Nozzle, injection nozzle, valve |
| 110 | Nozzle needle, injection needle, if appropriate in two parts/multiple parts, opening inward or outward |
| 112 | Upper longitudinal end section of the nozzle needle 110, needle piston, facing away from the nozzle 104 or a valve of the injector 1 |
| 114 | Energy storage means, spring element, helical spring, compression spring, nozzle needle spring, injection needle spring for prestressing of the nozzle needle 110 |
| 120 | (Upper) guide of the nozzle needle 110, nozzle needle sleeve |
| 121 | Needle bore |
| 210 | Intermediate plate |
| 211 | Pin bore |
| 212 | Transmission pin, leakage pin, $\Delta p$ ($p_{22} - p_\infty$) high |
| 220 | Control plate |
| 221 | Piston bore |
| 222 | Control piston |
| 223 | Upper end face of control piston 222, boundary of piston control space 22, $p_{22}$ |
| 224 | Lower end face of the control piston 222, $p_R$ |
| 225 | Energy storage means, spring element, helical spring, compression spring for prestressing of the control piston 222 |
| 230 | Plate |
| 232 | Fluid restrictor, damping restrictor |
| 400 | Injector body, injector housing with high-pressure line 402 leading to nozzle space 102 |
| 402 | High-pressure bore/line fluidically connected to nozzle space 102 through the control assembly 20, $p_R$ |
| 404 | Leakage port |
| 410 | Actuator, piezo actuator, electromagnetic actuator |
| 412 | Baseplate of actuator 410, preferably with integral activation projection for the transmission pin 212 |
| L | (Fuel) leakage, leakage flow, leakage quantity (general) |
| $L_{112}$ | Leakage (flow/quantity) at the nozzle needle 110 (needle piston 112), that is to say between nozzle needle sleeve 120 and nozzle needle 110 through needle bore 121, Leakage inflow; correction by means of instance of mechanical play (other instance of mechanical play) |
| $L_{212}$ | Leakage (flow/quantity) at the transmission pin 212, that is to say between intermediate plate 210 and transmission pin 212 through pin bore 211, leakage balance: $L_{212} = L_{122} + L_{222}$, leakage outflow, total leakage; owing to initial instance of mechanical play (instance of mechanical play) |
| $L_{222}$ | Leakage (flow/quantity) at the control piston 222, that is to say between control plate 220 and control piston 222 through piston bore 211, leakage inflow; correction by means of instance of mechanical play (other instance of mechanical play) |
| $\Delta p$ | Pressure drop, pressure difference (general) |
| $p_\infty$ | Ambient pressure where $p_\infty = p_{42} << p_{12} \approx/= p_{22} \leq p_R = p_{102}$ |
| $p_{12}$ | Pressure in needle control space 12 e.g. $p_{12} = p_R - 25$ bar to $p_R - 300$ bar |
| $p_{22}$ | Pressure in piston control space 22, e.g. $p_{12} = p_R - 25$ bar to $p_R - 300$ bar |
| $p_{42}$ | Pressure in leakage space 42, $p_{42} = p_\infty$ |
| $p_R$ | Rail pressure, current high pressure or maximum pressure in the injector 1 to over 2,500 bar, $p_R = p_{102}$ |
| $\Delta d_{setp}$ | Setpoint pairing play (general) |
| $\Delta d_{act}$ | Actual pairing play (general) |
| $\Delta d_{nom}$ | Nominal pairing play (general) |
| $\Delta d_{120_setp}$ | Setpoint pairing play of nozzle needle sleeve 120, that is to say of nozzle needle 110 in the nozzle needle sleeve 120 or the needle bore 121 |
| $\Delta d_{120_nom}$ | Nominal pairing play of nozzle needle sleeve 120, that is to say of nozzle needle 110 in the nozzle needle sleeve 120 or the needle bore 121 |

-continued

| | |
|---|---|
| $\Delta d_{222_act}$ | Actual pairing play of control piston 222, that is to say of control piston 222 in the control plate 220 or the piston bore 221 |
| $\Delta d_{222_nom}$ | Nominal pairing play of control piston 222, that is to say of control piston 222 in the control plate 220 or the piston bore 221 |
| $d_{120}$ | (Internal) diameter of the nozzle needle sleeve 120 |
| $l_{120}$ | Length of nozzle needle sleeve 120 |
| $d_{222}$ | Diameter of the control piston 222 |
| $l_{222}$ | Length of the control piston 222 |
| E | Energy, charge, corresponds to the electrical voltage present at the actuator 410 |

What is claimed is:

1. A method for producing a plurality of fuel injectors for motor vehicles, each respective fuel injector including a plurality of multi-component pairings, each multi-component pairing comprising a physical pairing between two or more components, said physical pairing between the two or more components resulting in an interaction that defines a multi-component pairing play that affects an operational aspect of each respective fuel injector, the method comprising:

for each of plurality of fuel injectors:

assembling an instance of a first component with an instance of a second component to define a multi-component pairing of the first and second components;

determining a first multi-component pairing play metric resulting from the multi-component pairing of the first and second components, the first multi-component pairing play metric comprising a first leakage metric, a first pressure metric, a first flow rate metric, a first measured size metric, or a first shape metric;

determining a combined multi-component setpoint value as a function of the determined first multi-component pairing play metric, the combined multi-component setpoint value representing a sum of at least two nominal multi-component pairing plays associated with at least two additional multi-component pairings of instances of additional components to be assembled in the respective fuel injector;

assembling the at least two additional multi-component pairings of instances of additional components in the respective fuel injector to define respective additional multi-component pairings of the additional components;

for each of the respective additional multi-component pairings of the additional components, determining a respective additional multi-component pairing play metric resulting from the respective additional multi-component pairing of additional components, each respective additional multi-component pairing play metric comprising an additional leakage metric, an additional pressure metric, an additional flow rate metric, or an additional shape metric;

determining a sum of the respective additional multi-component pairing play metrics for the respective additional multi-component pairings of the additional components; and performing a pairing evaluation by comparing the sum of the respective additional multi-component pairing play metrics with the combined multi-component setpoint value;

for at least one of the fuel injectors, replacing at least one instance of at least one of the additional multi-component pairings of instances of additional components in the respective fuel injector based on a result of the pairing evaluation for the respective fuel injector;

matching the plurality of multi-component pairings for each of the plurality of fuel injectors such that a total metric resulting from matched multi-component pairings of the first and second components and the additional multi-component pairings of the additional components of each respective fuel injector is approximately the same across the plurality of fuel injectors, the total metric comprising a total leakage metric, a total pressure metric, a total flow rate metric, a total measured size metric, or a total shape metric with respect to the first multi-component pairing play metric and the respective additional multi-component pairing play metrics; and assembling the plurality of fuel injectors, including for each fuel injector, assembling the matched plurality of multi-component pairings.

2. The method of claim 1, wherein the total metric comprises a total leakage or a pressure difference at a transmission pin of each fuel injector.

3. A method for producing a fuel injector for a direct injection system of an internal combustion engine, the fuel injector including at least two different subassemblies of mechanical components, each subassembly including a multi-component pairing of instances of mechanical components relevant to at least one of injection quantities, leakage quantities, or pressure differences, each subassembly having a corresponding mechanical play between the paired instances of mechanical components, the method comprising:

selecting an instance of a first mechanical component and an instance of a second mechanical component from a plurality of instances of first and second mechanical components for a first subassembly of the fuel injector, wherein the selected instances of the first and second mechanical components, when paired together to define a respective first-second mechanical component pairing, provide a first corresponding leakage or a first pressure difference;

selecting an instance of a third mechanical component and an instance of a fourth mechanical component from a plurality of instances of third and fourth mechanical components for a second subassembly of the fuel injector, wherein the selected instances of the third and fourth mechanical components, when paired together to define a respective third-fourth mechanical component pairing, provide a second corresponding leakage or a second pressure difference;

wherein the selected instances of the third and fourth mechanical components are selected for the second subassembly based on (a) the first corresponding leakage or first pressure difference provided by the pairing of the selected instances of the first and second mechanical components and (b) the second corresponding leakage or second pressure difference provided by the pairing of the selected instances of the third and fourth mechanical components; and assembling the first subassembly including the selected instances of the first and second mechanical components, and the second subassembly including the selected instances of the third and fourth mechanical components, in the fuel injector.

4. The method of claim 3, wherein the selected instances of the first, second, third, and fourth mechanical components of the first and second subassemblies are selected such that at least one of:

a leakage inflow to a first control space of the injector corresponds to a leakage outflow downstream of the first control space, or a pressure difference between a nozzle space and a second control space of the injector remains the same or decreases.

5. The method of claim 3, wherein a setpoint mechanical play of one subassembly of the injector is paired with an actual mechanical play of another subassembly of the injector.

6. The method of claim 3, wherein the fuel injector includes three different subassemblies of components, and instances of two of three subassemblies are selected based on the mechanical play associated with a selected pairing of instances of a third subassembly.

7. The method of claim 3, wherein each of the first and second subassemblies of mechanical components comprises at least one of a nozzle needle in a guide of the nozzle needle, a transmission pin in an intermediate plate, or a control piston in a control plate.

8. The method of claim 3, wherein the selected instances of the third and fourth mechanical components are selected for the second subassembly based on at least one test point or at least one test series for at least one of the first subassembly and the second subassembly.

9. The method of claim 3, further comprising:

determining a respective instance of mechanical play by measuring a gas leakage, measuring a throughflow rate, identifying a diameter, or identifying a component shape that corresponds to each respective multi-component pairing of instances of mechanical components.

10. A fuel injector for a direct injection system of an internal combustion engine, comprising:

at least two different subassemblies of mechanical components, each subassembly including a multi-component pairing of instances of mechanical components relevant to at least one of injection quantities, leakage quantities, or pressure differences, each subassembly having a corresponding mechanical play between the paired instances of mechanical components, the at least two different subassemblies comprising:

a first subassembly of a first plurality of mechanical components that, when paired together, provide a first mechanical play creating a first corresponding leakage or a first pressure difference; and a second subassembly of a second plurality of mechanical components that, when paired together, provide a second mechanical play creating a second corresponding leakage or a second pressure difference;

wherein paired instances of the second plurality of mechanical components of the second subassembly are selected based on the first corresponding leakage or first pressure difference created by the first mechanical play provided by pairing the first plurality of mechanical components and the second corresponding leakage or second pressure difference created by the second mechanical play provided by paired instances of the second plurality of mechanical components.

11. The fuel injector of claim 10, wherein the first and second subassemblies of mechanical components of the fuel injector include at least two of a nozzle needle in a guide of the nozzle needle, a transmission pin in an intermediate plate, or a control piston in a control plate are paired with one another.

12. The fuel injector of claim 10, wherein the fuel injector does not have a control valve or a servo valve which actuates the injection quantities of the fuel injector.

* * * * *